US005526869A

United States Patent [19]

Sears, Jr.

[11] Patent Number: 5,526,869

[45] Date of Patent: Jun. 18, 1996

[54] MOLD FOR CONTINUOUS CASTING SYSTEM

[75] Inventor: James B. Sears, Jr., Riverview, Mich.

[73] Assignee: Gladwin Corporation, Bryn Mawr, Pa.

[21] Appl. No.: 314,746

[22] Filed: Sep. 29, 1994

[51] Int. Cl.[6] ..... B22D 11/124; B22D 27/04; B22D 11/124

[52] U.S. Cl. ..... 164/443; 164/348; 164/485

[58] Field of Search ..... 164/348, 443, 164/485

[56] References Cited

U.S. PATENT DOCUMENTS 3,763,920 10/1973 Auman et al. ..... 164/443

FOREIGN PATENT DOCUMENTS 3-42144 2/1991 Japan ..... 164/485
952422 8/1982 U.S.S.R. ..... 164/443

*Primary Examiner*—Jack W. Lavinder
*Assistant Examiner*—I. -H. Lin
*Attorney, Agent, or Firm*—Woodcock Washburn Kurtz Mackiewicz & Norris

[57] ABSTRACT

An improved mold for a continuous casting process includes an outer wall that has a plenum chamber defined in an inner surface thereof and at least one passage for communicating the plenum chamber with an external coolant conduit. The mold further includes a liner that is secured to the inner surface of the outer wall. The liner has a number of slots defined in an inner wall thereof which, together with the outer wall, define a number of passages for transporting coolant to cool the liner during operation of the mold. Each of the slots has a radiused transition portion that is proximate to a location where the slot communicates with the plenum. The transition portion decreases in cross-section as the slot approaches the plenum. The mold further includes a velocity plate that is positioned between the plenum and the transition portion to limit an opening by which coolant may flow between the plenum and the transition portion. The velocity plate has a tapered cutout portion defined in a side thereof that faces the transition portion. The combined effect of the cutout portion and the transition portion is to define a flowpath that induces a substantially constant, elevated coolant flow velocity throughout the entire mold, prolonging the life of the mold. A method of retrofitting a mold to include a velocity plate is also disclosed.

17 Claims, 4 Drawing Sheets

MOLD FOR CONTINUOUS CASTING SYSTEM

BACKGROUND OF THE INVENTION

1. Field of the Invention

This invention relates broadly to the field of metal production and casting. More specifically, this invention relates to an improved mold for a continuous casting system that has a longer useful life, improves the uniformity of heat removal, and turns out a better product than conventional continuous casting molds do.

2. Description of the Prior Art

A conventional continuous casting mold includes a number of liner plates, usually made of copper, and outer walls surrounding the liner plates. The liner plates define a portion of the mold that contacts the molten metal during the casting process. Parallel vertically extending water circulation slots or passageways are provided between the outer walls and the liner plates to cool the liner plates. During operation, water is introduced to these slots, usually at the bottom end of the mold, from a water supply via an inlet plenum that is in communication with all of the slots in a liner plate. The cooling effect so achieved causes an outer skin of the molten metal to solidify as it passes through the mold. The solidification is then completed after the semi-solidified casting leaves the mold by spraying additional coolant, typically water, directly onto the casting. This method of metal production is highly efficient, and is in wide use in the United States and throughout the world.

Briefly referring to FIG. 4, both the top and bottom ends of each slot or passageway 22 are conventionally radiused into the plenum 14 at a transition portion 28 in order to minimize flow resistance. Considering that plenum 22 extends along an entire side of a liner plate 20 while the slots 22 are spaced periodically, the plenum 14 is relatively large in a cross-section taken along a normal to the flow direction of the water when compared to the combined cross-sections of the slots 22. As a result, water flow velocity in the plenum area 14 and in the adjacent transition portion 28 tends to be materially less than the water flow velocity in the main portion of the slots 22. In one calculation that was done by the inventor, flow velocity in the plenum area was found to be 2–3 feet per second, while the flow rate in the main portion of the slots was estimated at 20–30 feet per second, a ten-fold difference. This flow velocity differential causes the liner plate to be cooled more effectively at its center than at its top and the bottom. In fact, the low velocity area at the top of a liner plate has, even when positioned adjacent to the meniscus of the molten metal in the mold, been measured to have as high a temperature than areas that are about two inches below the meniscus, when, if the cooling effect was even, it would be expected to have a lower temperature. This uneven cooling effect causes expansion stresses that substantially limit the life of the liner plates.

This invention solves the velocity problem by interposing a velocity plate between the plenum and the transition portion of the slot. The velocity plate increases the velocity of the coolant water at the top and the bottom of the liner plate.

Ideally, only the very top and bottom ends of the slot 22 in a conventional mold should be radiused, and it would be a fairly small radius. The mold that is disclosed in U.S. Pat. No. 3,763,920 to Auman et al. ("Auman") shows a relatively small radius. However, in practice the slot ends tend to end up with a much longer radius, as is shown in FIG. 4, because the slots 22 are cut into the liner plate 20 by a side mill cutter that has a relatively large diameter. This is almost certainly the case in real-world embodiments of the Auman mold. Auman also discloses a dispersion plate that is positioned between its plenum and cooling slots to break the momentum of the inflowing water and equalize flow rate among the different slots. In practice, the water flow in an Auman mold would be impeded because of the narrow gap that is defined between the dispersion plate and the larger-radius transition portion of the cooling slots that the mold would be likely to have. A need exists, then, to ensure that the velocity plate in this invention does not have similar problems.

SUMMARY OF THE INVENTION

It is an object of the invention to provide an improved mold for continuous metal casting that provides a more balanced cooling effect than has heretofore been achieved by conventional molds.

It is further an object of the invention to provide such an improved mold without creating flow impediment problems of the type that would likely be encountered in a design such as Auman's.

It is yet further an object of the invention to provide an improved method of retrofitting a mold so as to achieve the benefits discussed above.

In order to achieve the above and other objects of the invention, an improved mold for a continuous casting process according to a first aspect of the invention includes an outer wall, the outer wall having a plenum chamber defined in an inner surface thereof and at least one passage for communicating the plenum chamber with an external coolant conduit; a liner that is secured to the inner surface of the outer wall, the liner having a number of slots defined in an inner wall thereof which, together with the outer wall, define a number of passages for transporting coolant to cool the liner during operation of the mold, each of the slots having a radiused transition portion that is proximate to a location where the slot communicates with the plenum, the transition portion decreasing in cross-section near the plenum; and a velocity plate positioned between the plenum and the transition portion to limit an opening by which coolant may flow between the plenum and the transition portion, the velocity plate having a tapered cutout portion defined therein in a side thereof that faces the transition portion, whereby the velocity of coolant flowing between the transition portion and the plenum is increased over conventional designs and is made constant over the entire transition portion by the combined profiles of the transition portion and the tapered cutout portion.

According to a second aspect of the invention, an improved mold for a continuous casting process includes four outer walls, each of the outer walls having a plenum chamber defined in an inner surface thereof and at least one passage for communicating the plenum chamber with an external coolant conduit; four liner walls, each of the liner walls being secured to the inner surface of one of the outer walls, the liner walls together defining a mold surface through which molten material may be passed and shaped, each of the liner walls having a number of slots defined in an inner surface thereof which, together with the respective outer wall, define a number of passages for transporting coolant to cool the liner during operation of the mold, each of the slots having a radiused transition portion that is proximate to a location where the slot communicates with the plenum, the transition portion decreasing in cross-section as the slot nears the plenum; and a velocity plate positioned between the plenum and the transition portion to limit an opening by which coolant may flow between the plenum and the transition portion, the velocity plate having a tapered cutout portion defined therein in a side thereof that faces the transition portion, whereby the velocity of coolant flowing between the transition portion and the plenum is increased over conventional designs and is made constant over the entire transition portion by the combined profiles of the transition portion and the tapered cutout portion.

According to a third aspect of the invention, a method of retrofitting a continuous casting mold of the type that includes an inner liner having a number of coolant passages defined therein and a plenum that is in communication with the passages, the passages having a transition portion that decreases in cross-section proximate the plenum, includes steps of: (a) opening the mold to expose the plenum and the transition portion; (b) securing a velocity plate between the plenum and the transition portion that is sized and proportioned to provide a limited opening between the plenum and the transition portion, and is tapered on a side facing the transition portion so as to induce a substantially constant coolant flow velocity within the transition portion; and (c) resealing the mold with the velocity plate mounted therein.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
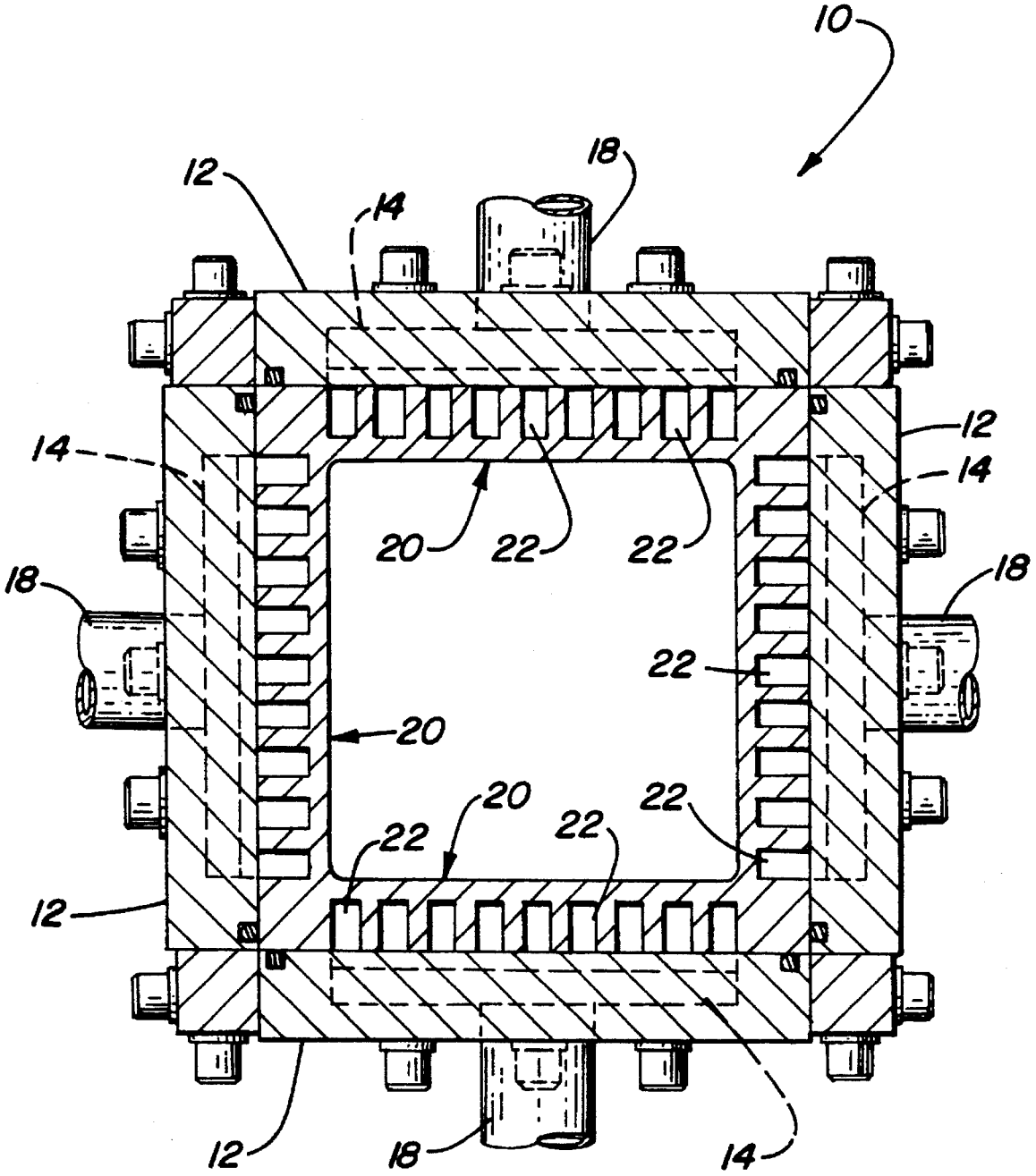
FIG. 1 is a cross-sectional fragmentary top view of an improved continuous casting mold that is constructed according to a preferred embodiment of the invention.
Figure 5:
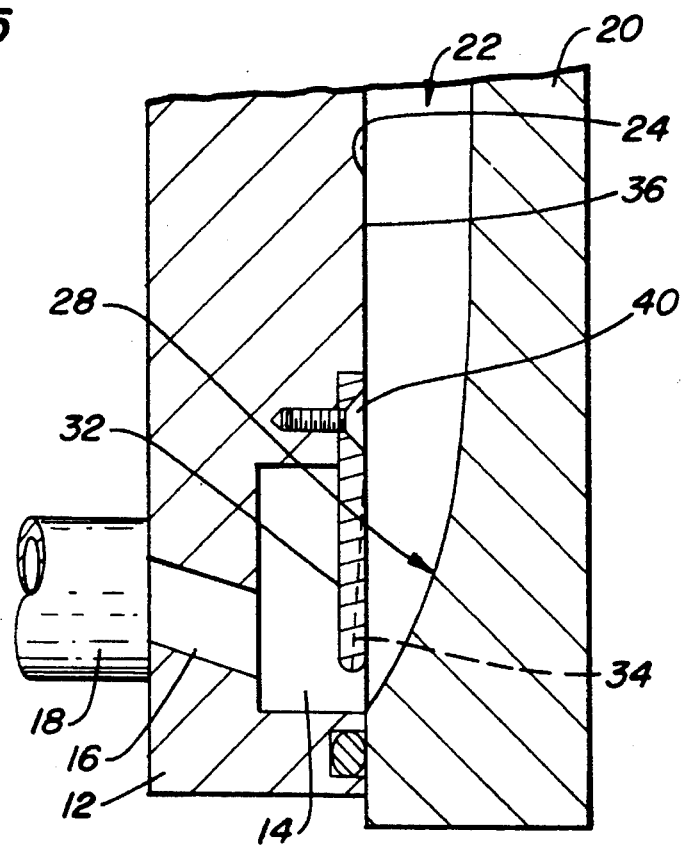
FIG. 5 is a fragmentary cross-sectional view of a portion of the mold that is depicted in FIGS. 1–3, corresponding to FIG. 4.

Referring now to the drawings, wherein like reference numerals designate corresponding structure throughout the views, and referring in particular to FIG. 1, an improved continuous casting mold 10 that is constructed according to a preferred embodiment of the invention includes four outer walls 12 that each have a plenum 14 defined therein, as may be seen in FIG. 5. Each of the outer walls 12 further has a passage 16 defined therein, as may also be seen in FIG. 5, to communicate plenum 14 with a external conduit of coolant, which in the preferred embodiment is a water inlet supply pipe 18.

Continuous casting mold 10 also includes four liner walls 20, each of which is secured to an inner surface 36, respectively, of an outer wall 12, as may best be seen in FIGS. 1 and 5. The liner walls 20 together define a mold surface through which molten material such as steel may be passed and shaped, as is well known in this area of technology. Each liner 20 or liner plate is preferably fabricated from a material that has high thermal connectivity, preferably copper, as is also well known in this technical area. As may be seen in FIG. 1, each liner wall 20 has a number of slots 22 defined in an inner surface 24 thereof which, together with the respective outer wall 12, defines a number of passages 26, shown in FIG. 6, for transporting coolant such as water to cool the liner 20 during operation of the mold 10.

As may best be seen in FIG. 5, each of the slots 22 has a radiused transition portion 28 that is proximate to a location where slot 22 communicates with the plenum 14. As is also depicted in FIG. 5, the transition portion 28 decreases in cross section as the slot 22 nears the plenum 14. The radius of the transition portion 28 is fairly large, for the reasons that are discussed above in the discussion of the problems that are associated with the prior art.

Figure 4:
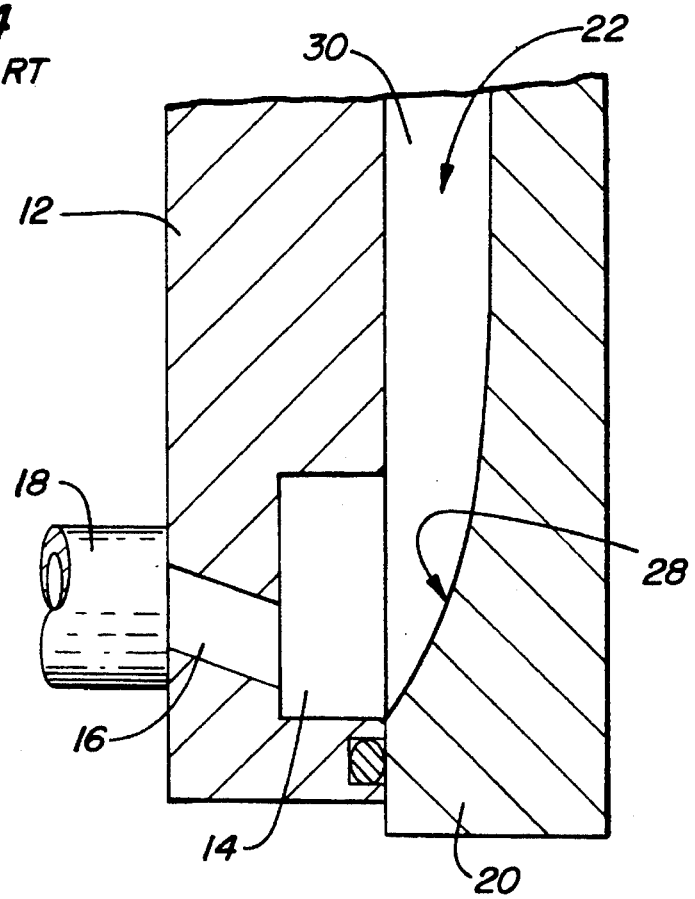
FIG. 4 PRIOR ART
FIG. 4 is a fragmentary cross-sectional view of a portion of a conventional continuous casting mold.

FIG. 4 depicts a conventional mold, which also includes a plenum 14, a slot 22 and 1 radiused transition portion 28 that has a relatively large diameter. For the reasons discussed above, the water velocity in the plenum chamber and by the radius transition portion 28 is relatively low in comparison to that in a high velocity region 30 of the slot 22.

Figure 2:
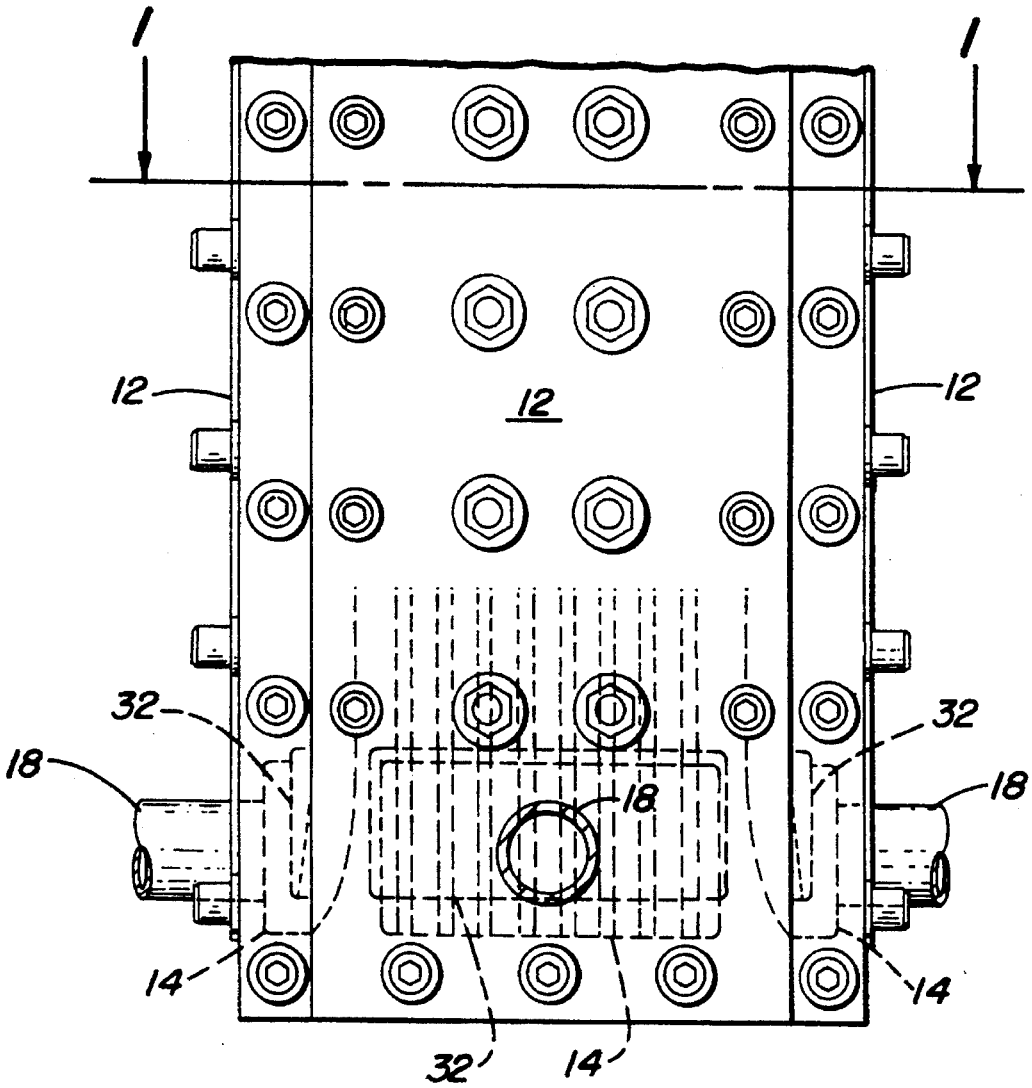
FIG. 2 is a fragmentary side elevational view of the casting mold depicted in FIG. 1, with certain internal components illustrated by hidden lines.
Figure 3:
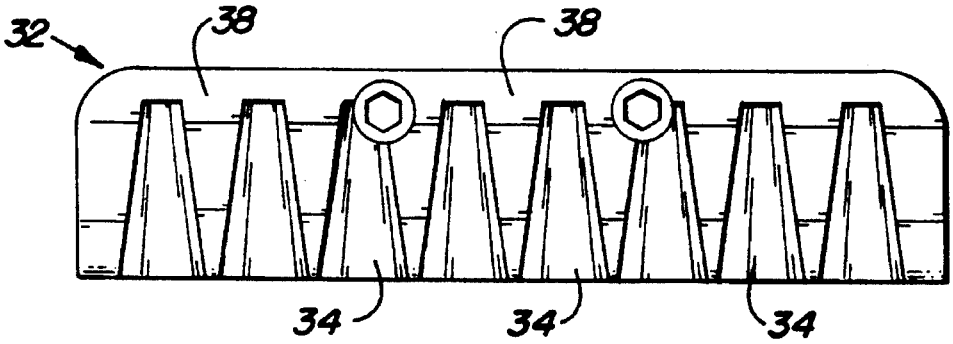
FIG. 3 is a side elevational view of a component of the mold that is depicted in FIGS. 1 and 2.

Referring again to FIG. 5, one important aspect of the invention involves the provision of a velocity plate 32 that is positioned between the plenum 14 and the transition portion 28 of the slot 22. Velocity plate 32 functions to limit an opening through which coolant may flow between plenum 14 and transition portion 28, thereby increasing the velocity of coolant flow at this point. Because of the large radius of the transition portion 28, velocity plate 32 would create a significant impediment to water flow between the plenum 14 and the slot 22, if it were not for the provision of a number of tapered cutout portions 34 that are defined in a side of velocity plate 32 that faces the transition portion 28 of slot 22. Looking briefly to FIGS. 2 and 3, it will be seen that a cutout portion 34 is provided on velocity plate 32 for each of the slots 22 that are defined in the liner plate 20. The cutout portions 34 are depicted in FIG. 3 in contrast to the flat portions 38.

Velocity plate 32 is preferably secured to outer wall 12 by means of a bolt that presents substantially no resistance to coolant flow, such as the flat head bolt 40 that is depicted in FIG. 5.

Looking again to FIG. 5, it will be seen that the gap between velocity plate 32 and radiused transition portion 28 is less at the bottom of the velocity plate 32 than it is at the top of the velocity plate 32. However, as may be seen in FIG. 3, each of the cutout portions 34 in velocity plate 32 is substantially wider at the bottom of the velocity plate 32 than at the top of the velocity plate 32. This has the effect of maintaining a substantially uniform cross section, in a direction that is normal to the flow of coolant during operation, from the plenum 14 to the top of the region that is bounded by velocity plate 32 and transition portion 28, into the main portion of the slot 22. As a result, flow velocity remains relatively constant from the point the water leaves plenum 14 to the main portion of the slot 22. Preferably, this will be within the range of substantially 20 feet per second to about 30 feet per second. As a result, the cooling rate along this portion liner 20 will be relatively even, minimizing stresses and prolonging the life of the liner 20.

Figure 6:
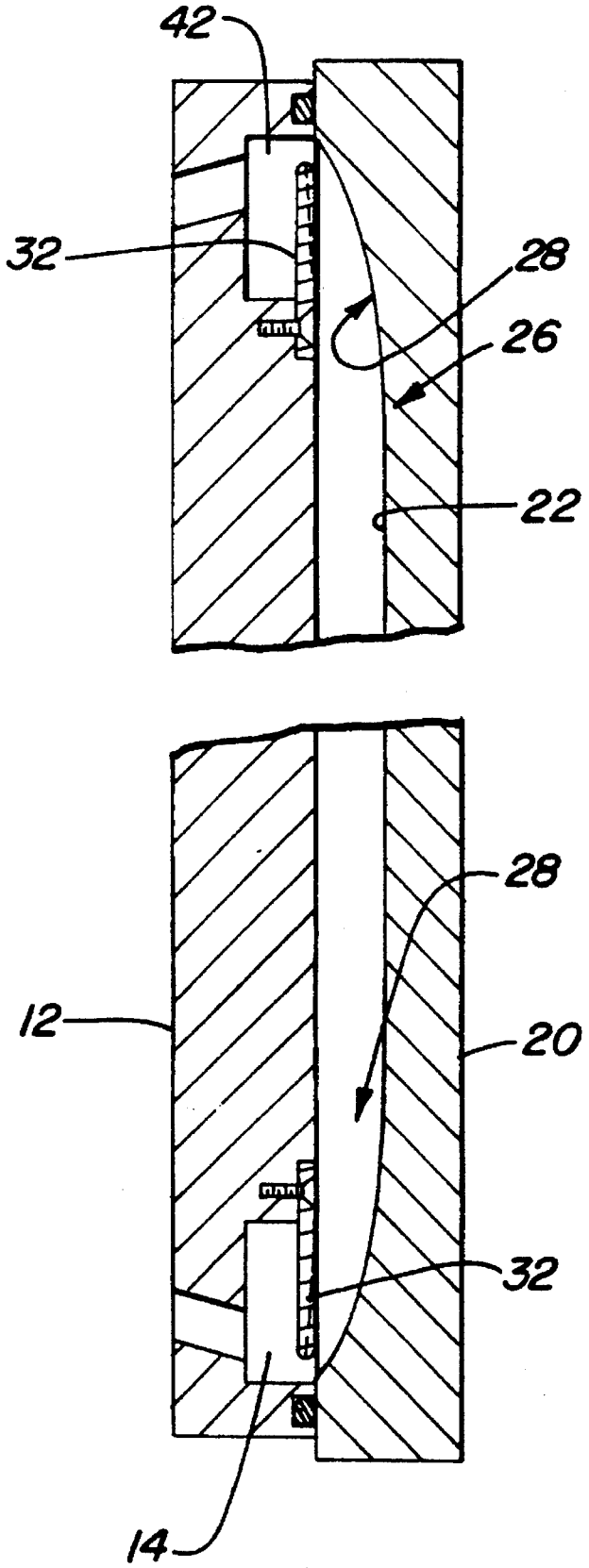
FIG. 6 is a fragmentary cross-sectional view of another portion of the mold that is depicted in FIGS. 1–3 and 5.

As may be seen in FIG. 6, a velocity plate 32 is preferably mounted at both the top of the slot and at the bottom of the slot. However, it is most essential that a velocity plate be mounted at the top of the slot, because the minimization of mold face temperature gradients is most important at the top of the slot, which is close to the point of initial solidification or meniscus of the metal being casted.

The invention also embraces a method of retrofitting a continuous casting mold of the type described above by separating the mold elements to expose the plenum and the transition portion, securing a velocity plate of the type described above between the plenum and the transition portion, and resealing the mold with the velocity plate mounted therein. This method can readily be envisioned by comparing FIG. 4 and 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved mold for a continuous casting process, comprising:

an outer wall, said outer wall having a plenum chamber defined in an inner surface thereof and at least one passage for communicating said plenum chamber with an external coolant conduit;

a liner that is secured to said inner surface of said outer wall, said liner having a number of slots defined in an inner wall thereof which, together with said outer wall, define a number of passages for transporting coolant to cool said liner during operation of said mold, each of said slots having an upper end and a lower end and having a radiused transition portion at at least said upper end that is proximate to a location where said slot communicates with said plenum, said transition portion decreasing in cross-section near said plenum; and a velocity plate positioned between said plenum and said transition portion at said upper end of said slots to limit an opening by which coolant may flow between said plenum and said transition portion, said velocity plate having a tapered cutout portion defined therein in a side thereof that faces said transition portion, whereby the velocity of coolant flowing between said transition portion and said plenum is increased over conventional designs and is made constant over the entire transition portion by the combined profiles of the transition portion and the tapered cutout portion.

2. A continuous casting mold according to claim 1, wherein said plenum is an inlet plenum.

3. A continous casting mold according to claim 1, wherein said plenum is an outlet plenum.

4. A continuous casting mold according to claim 1, wherein said cutout portion is tapered to increase in width in a direction toward said opening.

5. A continuous casting mold according to claim 1, wherein said cutout portion is shaped and proportioned so as to ensure that coolant between said velocity plate and said transition region will flow at a rate that is substantially equal to the flow rate through said slots.

6. A continuous casting mold according to claim 1, wherein said cutout portion is shaped and proportioned so as to ensure that coolant between said velocity plate and said transition region will flow at a rate within the range of substantially 20 feet per second to substantially 30 feet per second.

7. A continuous casting mold according to claim 1, wherein said velocity plate is secured to said outer wall.

8. A continuous casting mold according to claim 7, wherein said velocity plate is secured to said inner surface of said outer wall by a bolt that presents substantially no resistance to coolant flow.

9. An improved mold for a continuous casting process, comprising:

four outer walls, each of said outer walls having a plenum chamber defined in an inner surface thereof and at least one passage for communicating said plenum chamber with an external coolant conduit;

four liner walls, each of said liner walls being secured to said inner surface of one of said outer walls, said liner walls together defining a mold surface through which molten material may be passed and shaped, each of said liner walls having a number of slots defined in an inner surface thereof which, together with said respective outer wall, define a number of passages for transporting coolant to cool said liner during operation of said mold, each of said slots having a top end, a bottom end and a radiused transition portion at at least said top end that is proximate to a location where said slot communicates with said plenum, said transition portion decreasing in cross-section as said slot nears said plenum; and a velocity plate positioned between said plenum and said transition portion at said top end to limit an opening by which coolant may flow between said plenum and said transition portion, said velocity plate having a tapered cutout portion defined therein in a side thereof that faces said transition portion, whereby the velocity of coolant flowing between said transition portion and said plenum is increased over conventional designs and is made constant over the entire transition portion by the combined profiles of the transition portion and the tapered cutout portion.

10. A continuous casting mold according to claim 9, wherein said plenum is an inlet plenum.

11. A continous casting mold according to claim 9, wherein said plenum is an outlet plenum.

12. A continuous casting mold according to claim 9, wherein said cutout portion is tapered to increase in width in a direction toward said opening.

13. A continuous casting mold according to claim 9, wherein said cutout portion is shaped and proportioned so as to ensure that coolant between said velocity plate and said transition region will flow at a rate that is substantially equal to the flow rate through said slots.

14. A continuous casting mold according to claim 9, wherein said cutout portion is shaped and proportioned so as to ensure that coolant between said velocity plate and said transition region will flow at a rate within the range of substantially 20 feet per second to substantially 30 feet per second.

15. A continuous casting mold according to claim 9, wherein said velocity plate is secured to said outer wall.

16. A continuous casting mold according to claim 15, wherein said velocity plate is secured to said inner surface of said outer wall by a bolt that presents substantially no resistance to coolant flow.

17. A method of retrofitting a continuous casting mold of the type that comprises an inner liner having a number of coolant passages defined therein and a plenum that is in communication with said passages, said passages having a transition portion that decreases in cross-section proximate said plenum, comprising steps of:

(a) separating the mold elements to expose said plenum and said transition portion;

(b) securing a velocity plate between said plenum and said transition portion that is sized and proportioned to provide a limited opening between said plenum and said transition portion, the velocity plate having a tapered cutout portion facing said transition portion so as to induce a substantially constant coolant flow velocity within said transition portion; and (c) resealing the mold with the velocity plate mounted therein.

* * * * *

UNITED STATES PATENT AND TRADEMARK OFFICE

CERTIFICATE OF CORRECTION

PATENT NO. : 5,526,869

DATED : June 18, 1996

INVENTOR(S) : James B. Sears, Jr.

It is certified that error appears in the above-indentified patent and that said Letters Patent is hereby corrected as shown below:

On title page, item [56] "References Cited, add the following:

| | |
|---|---|
| 5,117,895 | Hargassner et al. |
| 3,511,305 | Wertli |
| 2,893,080 | Goss |
| 3,528,487 | Wognum et al. |
| 5,207,266 | Nakashima et al. |
| 5,201,909 | Von Wyl et al. |
| 4,640,337 | Sevastakis |
| 4,535,832 | Sevastakis |
| 4,182,397 | Schmucker et al. |
| 3,978,910 | Gladwin |
| 2,862,265 | Vaughn et al. |
| 2,169,893 | Crampton et al |
| 3,763,920 | Auman et al. |

Signed and Sealed this

Seventeenth Day of September, 1996

Bruce Lehman

*Attest:*

BRUCE LEHMAN

*Attesting Officer*

*Commissioner of Patents and Trademarks*